US006079849A

United States Patent [19]

Baliozian

[11] Patent Number: 6,079,849

[45] Date of Patent: Jun. 27, 2000

[54] LIGHTING DEVICE

[76] Inventor: Mardick Baliozian, 175 E. Delaware, Apartment 4717, Chicago, Ill. 60611

[21] Appl. No.: 08/871,180

[22] Filed: Jun. 9, 1997

[51] Int. Cl.[7] ..... F21V 21/14

[52] U.S. Cl. ..... 362/250; 362/238; 362/247

[58] Field of Search ..... 362/13–15, 228, 362/233, 238, 239, 247, 250

[56] References Cited

U.S. PATENT DOCUMENTS

| | | | |
|---|---|---|---|
| 2,097,250 | 10/1937 | Keith | 362/250 |
| 2,291,926 | 8/1942 | Sperti | 362/250 |
| 2,485,404 | 10/1949 | Noel | 362/15 |
| 3,094,284 | 6/1963 | Hehl | 362/13 |
| 4,225,906 | 9/1980 | Gulliksen et al. | 362/238 |
| 5,580,163 | 12/1996 | Johnson, II | 362/285 |

FOREIGN PATENT DOCUMENTS

| | | | |
|---|---|---|---|
| 0 303 254 | 2/1989 | European Pat. Off. . | |
| 1098162 | 7/1955 | France . | |
| 1534064 | 11/1968 | France . | |
| 37 00 549 | 7/1987 | Germany . | |
| 86 19 319 U | 11/1987 | Germany . | |
| 833676 | 4/1960 | United Kingdom | 362/250 |

*Primary Examiner*—Alan Cariaso
*Attorney, Agent, or Firm*—Rockey, Milnamow & Katz, Ltd.

[57] ABSTRACT

A lighting device comprising one or more light sources placed inside a main reflector, with the light emitted by the light source(s) being reflected by the reflector so as to create a projected pattern of light to be directed onto a subject to be illuminated, a focusable light being achieved by shifting means capable of displacing the light source(s) with regard to the optical axis of the reflector. Said shifting means are apt to displace said at least one light source in a direction to and from said optical axis of said reflector, in a plane substantially perpendicular to said axis. The light source(s) is (are) placed around said optical axis of the reflector and are movable in a radial direction with regard to the optical axis of said reflector.

15 Claims, 2 Drawing Sheets

LIGHTING DEVICE

BACKGROUND OF THE INVENTION

The invention is relative to the field of lighting in which lighting devices or luminaires are used comprising one or several light sources placed in a reflector to illuminate directly a subject, e. g. in luminaires used in television studios.

Such reflector light sources are well known which furthermore concentrate or focus the light, thus changing the angle lit. This can be achieved in several different ways.

The most common lighting device of this kind is provided with shifting means for moving backwards or forwards longitudinally along its optical axis the light source placed within the reflector so as to vary the projected pattern of light. However, such lighting devices present the following disadvantages:

When the light source is advanced to a maximum degree, the end of the lamp may protrude forward thus exposing it to potential breakage. Also a percentage of light emitted by the light source is consequently lost since it is no longer captured and reflected by the reflector. Furthermore, the light source may come in contact with accessories attached to the front of the reflector.

The housings and focusing systems of the lighting device must be made large in size in order to permit the above mentioned movement.

When the light source is moved backwards, it goes beyond the rear limit of the reflector, causing an increasing amount of light to be wasted since the reflector no longer receives this light and, therefore, cannot reflect it forward as desired.

When a small-size light source is used and when a wide-angle light pattern is desired, there is a "hole in the middle" since no light is reflected there.

Lighting devices have also been made with two light sources mounted eccentrically within a reflector and rotated around the optical axis of the reflector. The use of this type of fixture is very limited, due to the light pattern variation always being projected co-axially in the same fashion, in an uneven manner around the optical axis.

A variation of this type of lighting device has been made in which the rotational movement of two light sources is coupled to a longitudinal movement of them backwards and forwards along the optical axis of the reflector, so that the light can be more or less focused. However, its utility is extremely limited.

Lighting devices having multi-filament lamps have also been used. The filaments are in this case placed physically at different places within the lamp so that the surrounding reflector receives the light coming from different angles, thus projecting the light forward in a different manner. This system has certain disadvantages and limitations and except for automobile head lights, this system is rarely used since:

Special multi-filament lamps must be used.

The light pattern is limited and fixed by the above number of filaments within the lamp and their placement.

It is not continuously variable.

Another type of lighting device uses a reflector that has two separate sections with the same optical axis. A lamp is used in each level of the reflector and each section has different optical characteristics and diameter. So by switching on one lamp or the other, or both, the lighting effect changes. However, this device is rather complicated to produce and rather limited in use.

SUMMARY OF THE INVENTION

This invention is relative to a lighting device which overcomes the disadvantages of the prior art lighting devices.

Specifically, this invention is directed at making a lighting device using one main reflector and which is capable of varying the projected pattern of light either symmetrically or asymmetrically, and to do this without moving the light source(s) backward or forward longitudinally in the direction of the optical axis of the reflector or by rotation them around the optical axis of the reflector. As there is no backward and forward movement of the light source, the depth of the luminaire can be minimized. Furthermore, the light source(s) is (are) allowed to be moved without interference from the reflector or the accessories placed on its front face.

The lighting device according to the invention makes it possible to have a focusable light having a variable angle from less 40° to over 100° with a very high light output and efficiency. When used with fluorescent lamps, the lighting device of the invention achieves up to or even more than 100 Candelas per watt vs. 10 to 30 Candelas per watt being attained by other presently being made fluorescent lamp devices, which in addition are not focusable.

The lighting device made according to this invention can be used with one or more light sources which are placed inside a single reflector. Individual reflectors for each light are not needed. It is also possible to have interchangeable lightheads.

Furthermore, with the invention, normal lamps can be used instead of special "bi-focal" or "multi-focal" lamps.

The lighting device according to the invention comprises at least one light source placed inside a main reflector. The light emitted by the light source being reflected by the reflector so as to create a projected pattern to be directed onto a subject to be illuminated, a focusable light being achieved by shifting means capable of displacing said at least one light source with regard to an optical axis of the reflector.

According to an important aspect of the present invention, the shifting means are apt to displace said at least one light source in a direction to and from said optical axis of said reflector, in a plane substantially perpendicular to said axis.

According to a specific embodiment of the invention, at least two light sources are placed around said optical axis of the reflector and being movable in a radial direction with regard to the optical axis of said reflector.

Preferably, the light sources are regularly placed around said optical axis of the reflector.

According to an other embodiment of the invention, a fixed light source is placed in the optical axis of said reflector.

According to a further embodiment of the invention, the device comprises at least two light sources and said shifting means which are capable of moving simultaneously said light sources.

According to a further embodiment of the invention, the lighting device comprises at least two light sources and said shifting means are capable of moving separately the light sources.

According to a further aspect of the invention, the shifting means comprise a guide plate having at least one guide slot through which passes an extension of the base of said at least one light source, a cam plate being placed under the guide plate and having at least one cam cooperating with a light source base, the guide plate and the cam plate being capable of a relative rotating movement so as to displace the base of said light source base in said direction to an from the axis of said reflector.

According to a further aspect of the invention, the guide slots of said guide plate are rectilinear slots extending radially from the optical axis of said reflector and cams of the cam plate are curved.

According to a further aspect of the invention, the cams of the cam plate are slots.

According to a further aspect of the invention, the device comprises at least two light sources of different nature such as incandescent halogen lamps, fluorescent tubes, discharge lamps, electronic flash tubes.

According to a further aspect of the invention, the housing in which the shifting means are placed can be separated from said reflector in order to be replaced by an other housing with a different set of light sources.

Other features, advantages and objects of this invention will become apparent from the following description of embodiments of the invention taken in conjunction with the figures.

DESCRIPTION OF EMBODIMENTS OF THE INVENTION

Figure 1:
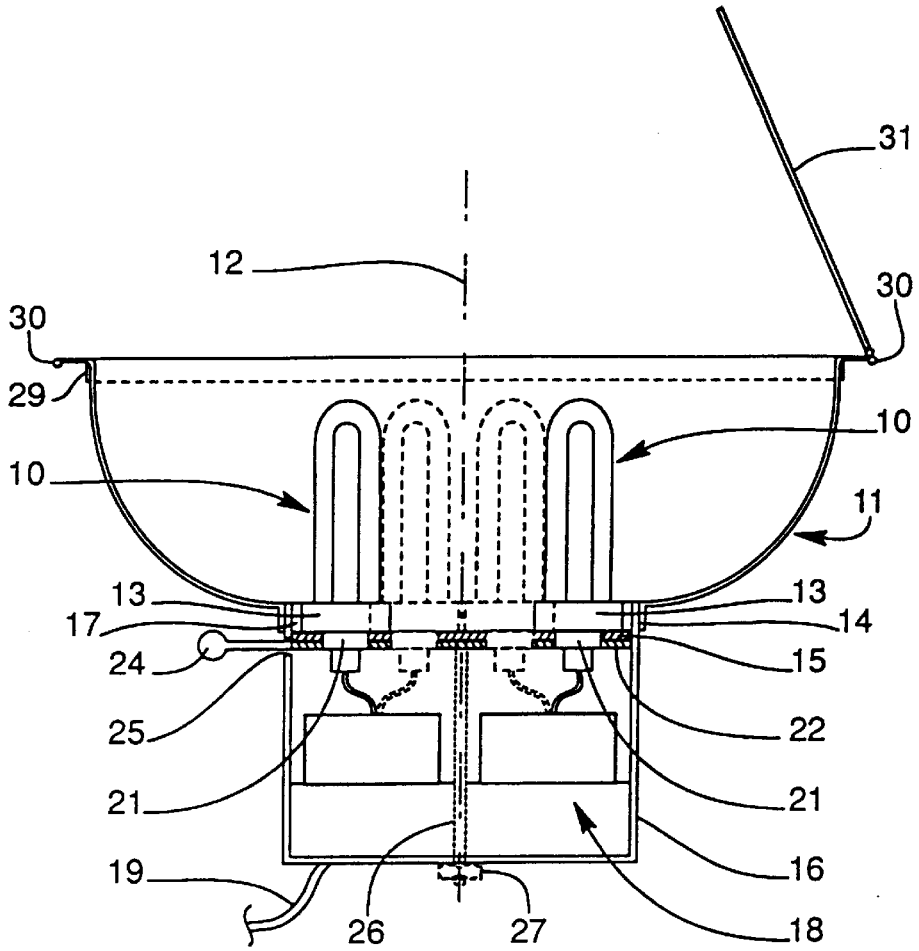
FIG. 1 is a schematic cross section view of one embodiment of the invention with two light sources.
Figure 2:
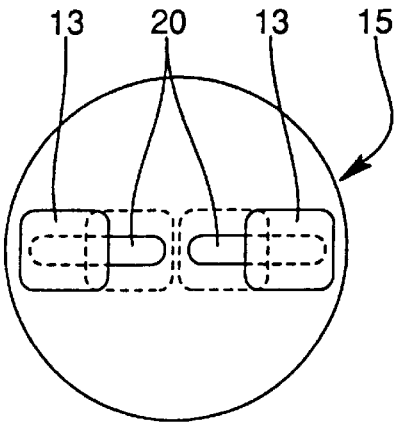
FIG. 2 is a schematic top view of a guide plate of shifting means of the two light sources of FIG. 1.
Figure 3:
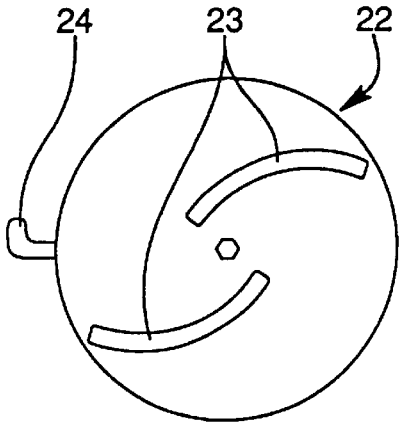
FIG. 3 is a schematic top view of a cam plate of shifting means of the two light sources of FIG. 1.

FIGS. 1–3 show a first embodiment of the invention. The lighting device shown comprises two light sources 10 in form of U-shaped light tubes which are placed inside a reflector 11, on opposite sides of the central optical axis 12 of this reflector.

The bases 13 of the lights sources 10 are disposed in a central opening 14 of the reflector on a base plate 15 constituting the front side of a housing 16 of the lighting device. The base plate 15 and the housing 16 have preferably a cylindrical form and the cylindrical side wall of the housing is extending above to base plate 15 so as to form a circular space 17 in which the bases of the light sources are disposed so that their light emitting parts start from a point near the level with the reflector opening.

The housing 16 preferably contains the electronic circuitry, ballasts and power supplies 18 of the lighting device. A main electrical input has the reference number 19 in FIG. 1.

The lighting device further comprises shifting means capable of displacing the light sources 10 with regard to the optical axis 12 of reflector 11.

For that purpose, the base plate 15 contains according to an embodiment of the invention rectilinear guide slots 20 (FIG. 2) constituting a guide plate for the lamp or tube bases 13 which are provided with an extension 21 passing through the slots. The dimension of this extension 21 is adapted to the width of the slot to insure an easy displacement of the extension along the slot.

The slots 20 are radially disposed and preferably but not necessary aligned so as to face each other on opposite sides of the optical axis 12 of the reflector 11 and they move outward in a perpendicular manner to this axis 12. Consequently, the tube bases 13 can be displaced in these guide slots 20 in a direction to and from the optical axis of the reflector, in a plane substantially perpendicular to this axis.

The shifting means further comprises a cam plate or disc 22 disposed immediately under the guide plate 15 in the housing 16 where it is mounted so as to be able to rotate around an axis which coincides with the longitudinal axis of the housing. The cams are in this embodiment in form of two curved slots 23, but they could of course as an alternative be in form of grooves made on the side of the cam disc facing the guide plate 15. The cams could also be constituted by additional guides attached to the cam disc 22.

Each curved slot 23 has one of its ends in the near of the center of the cam disc 22, whereas the opposite end is near to the periphery of the disc depending on the desired amount of movement.

The extensions 21 of the tube bases 13 extend into the cam slots 23 so as to be moved along the cam disc when this latter is rotating. The width of the cam slots 23 are adapted to the dimension of the extensions 21 so as to facilitate their sliding in the slots.

For controlling its rotation, the cam disc 22 is coupled to an arm 24 protruding from the housing through an oblong opening 25 in the wall. The shifting means according to this embodiments works as follows.

FIG. 2 shows in solid lines the position where the light source bases 13 are in their end position near to the periphery of the guide plate 15 and in broken lines the position where they are in their end position near to the center of the plate 15. They are moved from the first position to the second by rotating the cam disc in FIG. 3 and can of course take any intermediary position.

By moving the light sources to and from the optical axis of the reflector, the angle of incidence of the light rays hitting the reflector changes, thus changing their angle of reflectance. Hence, it is possible to direct the light rays to different places in space by varying the placement of the light sources on the guide base plate 15. Also, as a light source approaches the reflector surface, it subtends a bigger angle causing its angle of reflectance to increase. These facts are used in the invention to create a new, versatile and efficient luminaire.

For use in television studios where the lights are hung from above, the control means for displacing the light sources within the reflector is advantageously operated by a pole which is manipulated from the floor.

FIG. 1 also shows in broken lines alternative control means of the cam disc 22. They comprise a central shaft 26 connected with the disc 22 and having one end attached to a turning knob 27 placed outside the housing 16.

For use in television studios, the turning knob 27 can in the above mentioned case be operated by means of a cardan or universal joint to which is attached a turning cup.

It would of course be possible to have an other type of shifting means as e.g. a cone, the top of which enters between slidingly mounted and spring biased light source bases so as to displace the bases toward a peripheral position when penetrating further between the bases.

Other shifting means, including individual manual means, could also be provided so as to move the light sources independently of each other.

Figure 4:
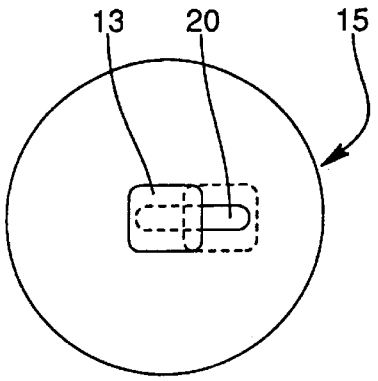
FIG. 4 is a schematic top view of a guide plate of shifting means of an embodiment having only one light source.
Figure 5:
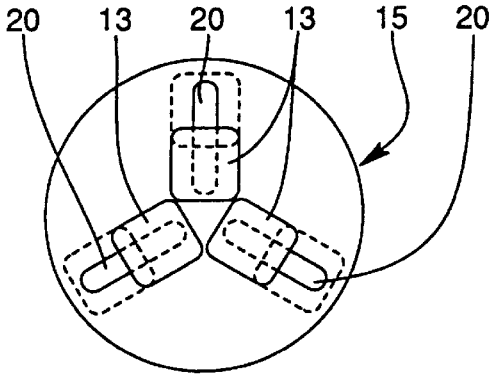
FIG. 5 is a schematic top view of a guide plate of shifting means of an embodiment having three light sources.
Figure 6:
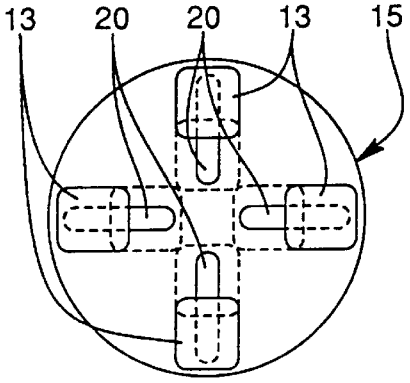
FIG. 6 is a schematic top view of a guide plate of shifting means of an embodiment having four light sources.
Figure 6A:
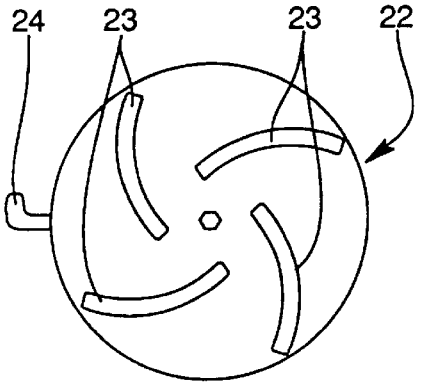
FIG. 6A is a schematic top view of a cam plate of shifting means of four light sources.

FIGS. 4–6 show some alternative embodiments having the same type of shifting means as the embodiment already described, but with a various number of light sources.

In FIG. 4, base 13 of one single light source can take a position either in the optical axis of the reflector or be moved along a radially extending guide slot 20 toward the periphery of the guide plate 15. In FIGS. 5–6, there are 3 respectively 4 light sources guided in regularly disposed radially extending guide slots 20 on the guide plate 15.

The movement of the light sources disposed as indicated in FIGS. 5 and 6 should be limited to where a "hole in the middle" appears so as to insure a homogeneous lighting pattern.

Figure 7:
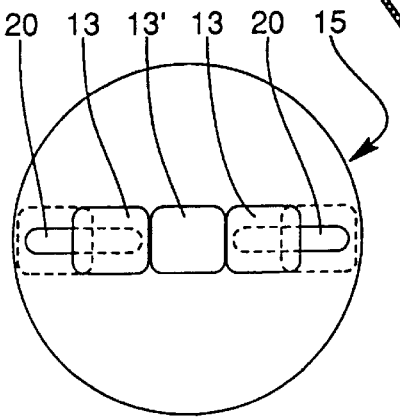
FIG. 7 is a schematic top view of a guide plate of shifting means of the two light sources of FIG. 1 combined with a centrally placed fixed light source.

To eliminate this "hole in the middle", FIG. 7 illustrates an advantageous embodiment with a light source having its base 13' centrally placed in a fixed manner in the central optical axis of the reflector 11. In the shown arrangement, two radially movable light source bases 13 are disposed on opposite sides of the fixed light source. Such an arrangement increases the total amount of light and also permits laterally placed light sources to be moved further away with regard to the optical axis of the reflector 11 without creating a "hole in the middle" which has less light.

Of course, such a centrally fixed light source could be used with any number of movable light sources. In tests carried out by the applicant, up to 8 light sources have been used with success.

A lighting device made in this manner, using a single row of light sources such as shown in FIGS. 2 and 7 will thus permit the light pattern to be made in a linear manner. This is especially advantageous whenever one wishes to light up backgrounds in studios or for lighting several people sitting in a row, such as at a News Desk. This also permits them to be lit without changing the lighting effect used on the set behind them, since if they are being lit in a horizontal manner, there will be little light falling on the scenery behind them, and no light is wasted by falling on the floor below their desk.

Furthermore, the housing 16 is advantageously mounted to the reflector 11 by quick release means such as a latching device to make it possible to have interchangeable housings provided with shifting means according to the invention.

Figure 8:
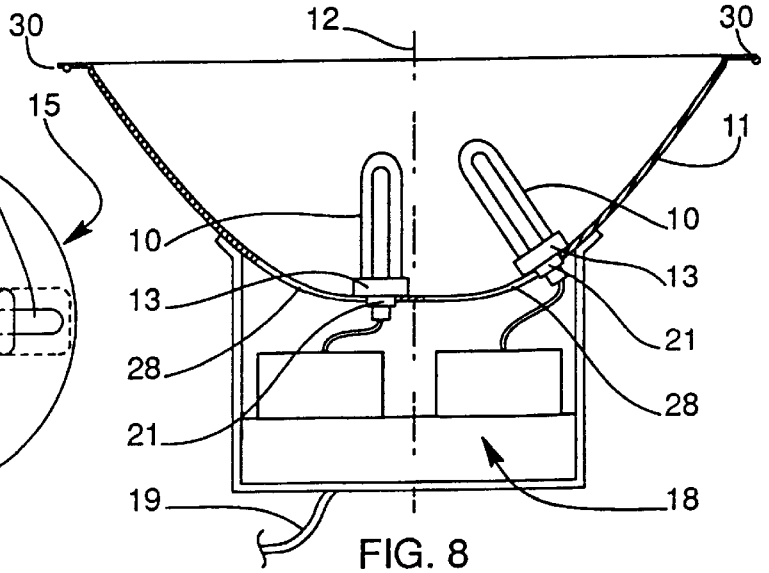
FIG. 8 is a schematic cross section view of a different embodiment of the invention with two light sources guided directly along the wall of the reflector.

FIG. 8 shows an other embodiment of the invention without any base plate on which the light source bases can move. In this case, the extensions of the light source bases are placed in slots 28 made directly in the wall of the reflector 11. The slots 28 extend outwards in the reflector in a plane which is substantially perpendicular to its optical axis 12.

The light source bases are attached to simple shifting means like e. g. push-and-pull and locking devices which are well known to one skilled in the Art.

The lighting device according to the invention makes it possible to use combinations of different kinds of light sources such as incandescent halogen lamps, fluorescent tubes powered by either low frequency or high frequency ballasts, discharge lamps of different kinds, electronic flash tubes.

Since additional means of controlling the light are often desirable, mounting means are provided for using different accessories.

These means for mounting can comprise a ridge 29 incorporated into the reflector 11 to hold gridspots, diffusers, colour filters, prismatic refracting light intensifiers. An outer lip 30 of the reflector 11 can be provided to hold different accessories such as pivoting barn doors 31, clip-on colour filters, clip-on light reflecting intensifiers. The mounting means may also comprise a ring for linking reflectors together in either a 45° or 60° manner or for attaching either an extra large size reflector or lightbox.

Means can also be provided either on reflector 11 or on the rear housing 16 to attach an L-shaped or U-shaped yoke for holding and tilting the lighting device in a conventional manner or for the holding of the lighting device on a flexible goose-neck or pan-tilt mount.

What is claimed is:

1. A lighting device comprising at least one light source placed inside a reflector, a light emitted by the light source being reflected by the reflector so as to create a projected pattern of light to be directed onto a subject to be illuminated, with a focusable light being achieved by shifting means capable of displacing said at least one light source with regard to an optical axis of the reflector, wherein said focusable light being achieved by said shifting means being apt to displace said at least one light source in a direction to and from said optical axis of said reflector, in a plane substantially perpendicular to said axis, so as to change the angle of incidence of the light hitting the reflector.

2. A lighting device as claimed in claim 1, wherein at least two light sources are placed around said optical axis of the reflector and being movable in a radial direction with regard to the optical axis of said reflector.

3. A lighting device as claimed in claim 2, wherein said at least two light sources are regularly placed around said optical axis of the reflector.

4. A lighting device as claimed in claim 2, wherein a fixed light source is placed in the optical axis of said reflector.

5. A lighting device as claimed in claim 1, wherein the device comprises at least two light sources and said shifting means are capable of moving simultaneously said light sources.

6. A lighting device as claimed in claim 1, wherein said device comprises at least two light sources and said shifting means are capable of moving separately the light sources.

7. A lighting device as claimed in claim 1, wherein said shifting means comprise a guide plate having at least one guide slot through which passes an extension of a base of said at least one light source, a cam plate being placed under the guide plate and having at least one cam cooperating with a light source base, the guide plate and the cam plate being capable of a relative rotating movement so as to displace the base of said light source base in said direction to and from the axis of said reflector.

8. A lighting device as claimed in claim 7, wherein said guide slot of said guide plate is a rectilinear slot extending radially outward from the optical axis of said reflector and said at least one cam of the cam plate is curved.

9. A lighting device as claimed in claim 8, wherein said at least one cam of the cam plate is a slot.

10. A lighting device as claimed in claim 1, wherein said shifting means are connected to outer control means for activating the shifting means.

11. A lighting device as claimed in claim 10, wherein said outer control means comprise an arm fixed to the shifting means and extending outside the device in a perpendicular direction to the axis of said reflector.

12. A lighting device as claimed in claim 10, wherein said outer control means comprises a rotational shaft extending in the axis of said reflector and connected to a turning knob outside the device.

13. A lighting device as claimed in claim 1, wherein said shifting means are capable of moving a base of said at least one light source along slots made in a wall of the reflector.

14. A lighting device as claimed in claim 1, wherein said device comprises at least two light sources of different nature such as incandescent halogen lamps, fluorescent tubes, discharge lamps, electronic flash tubes.

15. A lighting device as claimed in claim 1, wherein said shifting means are placed in a housing separable from said reflector in order to be replaced by another housing containing a different set of light sources.

* * * * *